US007384318B2

(12) United States Patent
Lamdiziz et al.

(10) Patent No.: US 7,384,318 B2
(45) Date of Patent: Jun. 10, 2008

(54) CONTACT HOUSING FOR AN ELECTRICAL PLUG CONNECTOR

(75) Inventors: Mohamed Lamdiziz, Marbach A.N. (DE); Eckhardt Philipp, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/803,811

(22) Filed: May 15, 2007

(65) Prior Publication Data

US 2007/0293101 A1 Dec. 20, 2007

(30) Foreign Application Priority Data

May 15, 2006 (DE) ..... 10 2006 022 542

(51) Int. Cl.
*H01R 4/48* (2006.01)

(52) U.S. Cl. ..... 439/816

(58) Field of Classification Search ..... 439/752, 439/595, 816, 271, 274, 587, 589, 523, 686
See application file for complete search history.

(56) References Cited

U.S. PATENT DOCUMENTS 6,109,965 A * 8/2000 Seko et al. ..... 439/595
6,328,614 B1 * 12/2001 Osawa ..... 439/752
2001/0055907 A1 * 12/2001 Murakami et al. ..... 439/595
2004/0076466 A1 * 4/2004 Nakamura ..... 403/292

* cited by examiner

*Primary Examiner*—Edwin A. León
(74) *Attorney, Agent, or Firm*—Kenyon & Kenyon LLP

(57) ABSTRACT

A contact housing for an electrical plug connector, having multiple contact chambers for receiving a respective contact body insertable through a placement opening into the contact chamber having, a respective elastically deflectable latching arm, protruding laterally into the contact chamber, for primary latching of the contact body inserted to its end position into the contact chamber, and having a respective locking element, displaceably guided transversely to the insertion direction of the contact body, that in its locked position protrudes, with a first locking projection, laterally into the contact chamber for secondary locking of the contact body latched in primary fashion therein. Provision is made that the locking element has a second locking projection that, in the locked position of the locking element, blocks the latching arm against deflection out of its position protruding into the contact chamber.

8 Claims, 4 Drawing Sheets

-PRIOR ART-

CONTACT HOUSING FOR AN ELECTRICAL PLUG CONNECTOR

BACKGROUND INFORMATION

Contact systems in which the individual contacts in a first working step come to a stop against the electrical leads, and in a second working step are latched into the contact chambers of the plug, are used at present in the automotive sector in electrical plug connectors. So-called clean-body contacts, among others, are used in this context. In these contact systems, elements of the contact chambers deflect into recesses or undercuts of the contacts and thereby provide primary latching of the contacts. In multi-part contact chamber systems, two primary latching types for clean-body contacts are known. In both cases the latching arms, with their latching hooklets, usually emerge as injection-molded parts from the lower part of the contact carrier as parts of the contact chamber walls. The first latching type is characterized in that the latching arm is attached to the contact chamber wall at the level of the contact shoulder, and the latching hooklet engages into a contact undercut in the vicinity of the contact opening. The latching arm grows out, so to speak, in the insertion direction, and when retained is loaded substantially axially in compression. The second latching type is characterized in that the latching arm is attached to the contact chamber wall at the level of the contact opening, and the latching hooklet engages over the contact shoulder or into a corresponding opening in the vicinity of the contact shoulder. The latching arm grows out, so to speak, opposite to the insertion direction, and when retained is loaded substantially axially in tension. In order to enhance functional reliability, customers are now requiring correct primary latching of the latching hooklets to be ensured by the fact that after assembly of the contact, the position of the latching arms is tested. For the first latching type, so-called spacer elements made of plastic, which are inserted from the plug face between the backs of the latching arms and the wall located therebehind, are already known. If a latching arm is not in the correct location, for example because it is not completely snapped into the contact, the spacer element is blocked and the placement state of the contact must be checked. When the spacer element is completely inserted, it prevents (usually unmonitored) reopening of the primary latch, thereby securing the position of the latching arm.

A general disadvantage of such spacer elements is that an additional part is required in the plug connectors in order to check the primary latching hooks, which means additional cost for the connection as a whole. For the second latching type, no comparable spacer systems that allow the position of the latching arms to be tested and secured are known at present.

In the contact chambers of plug connectors having a large number of pins, the contacts that have been latched in primary fashion are usually additionally checked, by way of a so-called secondary locking system, in terms of their correct position in the contact chamber, and are additionally secured at their correct insertion depth upon failure of the primary latching system. Plug connectors having many pins utilize, in many cases, so-called preassembled and transversely displaceable secondary locking plates that, in a clear position, initially permit unimpeded placement of the contacts into the contact chamber and then, at the end of the placement operation, are shifted at least one-half contact-chamber width transversely to the contact-chamber axes. With their locking contours protruding laterally into the contact chambers, the secondary locking plates on the one hand test for the correct insertion depth of the contacts, and on the other hand ensure additional locking.

SUMMARY OF THE INVENTION

It is an object of the present invention to provide a contact housing in such a way that the primary latching position of the latching arm can be tested for and secured without additional time expenditure during plug connector preparation, and without additional parts.

According to the present invention, on each of the locking elements for secondary locking (e.g. secondary locking plates or pins), a second locking projection (spacer element) is provided that makes it possible, simultaneously with activation of the secondary locking function, to test for the correct primary latching position of the latching arm and secure it. A considerable degree of functional reliability in the preparation of wiring harnesses is thereby achieved, with no need to accept additional costs (e.g. for additional parts). A further result is that two security tests for correct contact position, which in principle are independent of one another, are accomplished with a single element (locking element) in a single motion, without creating an additional time expenditure during wiring harness preparation.

In embodiments in which the latching arms are located below the secondary locking plane, the spacer elements extend in the contact insertion direction, beyond the secondary locking plane, as far as the primary latching arms. The spacer elements are disposed and dimensioned so that they allow unlimited deflection of the latching arm during the placement operation (i.e. in the clear position of the locking element) and upon closure of the secondary locking system are displaced behind at least the upper part of the latching arm so as to prevent inadvertent opening of the primary latch (for example if the electrical lead is pulled) as long as the second locking system is closed. If the latching arm is not completely snapped in, the spacer element is pushed in controlled fashion against the side of the latching arm upon closure of the locking element. The spacer element becomes blocked there, and indicates an incorrect primary latching position by way of an increase in closing force.

In embodiments in which the latching arm penetrates through the secondary locking plane, the contour recessed into the locking element around the latching arm assists complete deflection of the latching arm during contact placement, i.e. in the clear position of the locking element. In the locked position, the latching arm is blocked by the spacer element.

DETAILED DESCRIPTION

Figure 1:
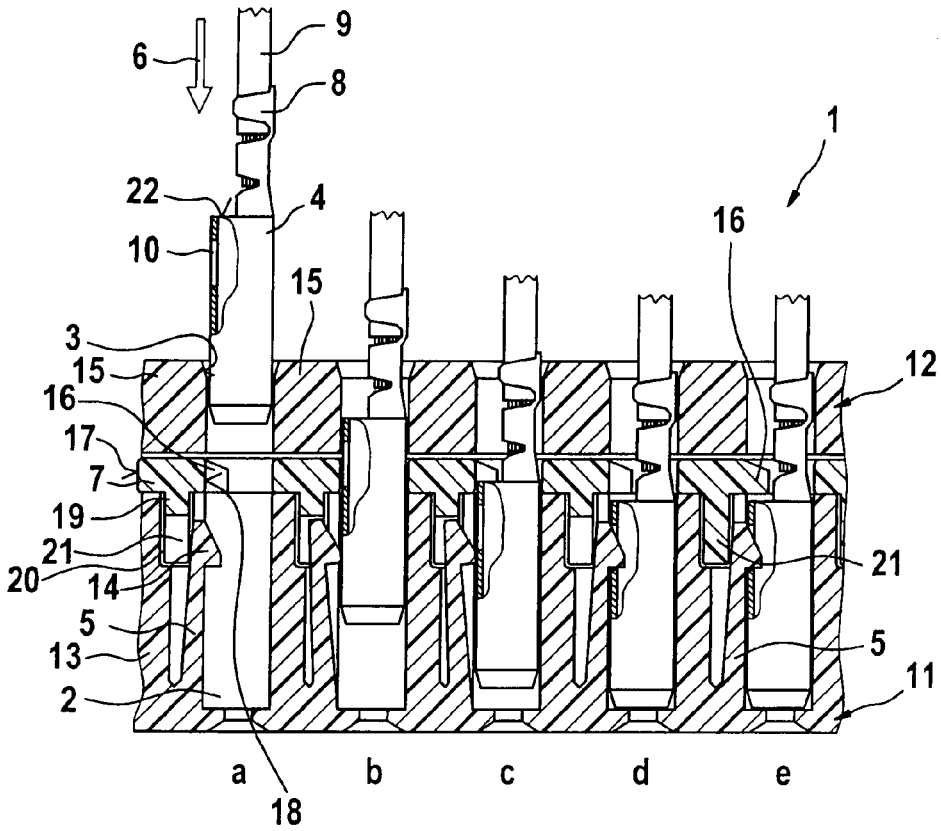
FIG. 1 shows, in a longitudinal section, a first exemplary embodiment of the contact housing according to the present invention, having multiple contact chambers and having contacts that are each inserted different distances into the contact chambers and latched in primary fashion and locked in secondary fashion therein.

Contact housing 1 shown in FIG. 1, for an electrical plug connector, encompasses five rows a-e, disposed next to one another, of contact chambers 2 for receiving a respective contact body (contact) 4 insertable through a placement opening 3 into contact chamber 2, a respective latching arm 5 for primary latching of contact body 4 inserted to its end position into contact chamber 2, and a respective locking element 7 guided displaceably, transversely to insertion direction 6 of contact body 4, between two adjacent contact chambers 2, for secondary locking of contact body 4 that has been latched in primary fashion in a contact chamber 2.

Contact body 4 has a crimp region (clamping region) 8 to which a portion of an electrical lead 9 is fixedly joined, and without crimp region 8 has a rectangular cross section. A latching recess 10 is provided in a side wall of contact body 4.

Locking element 7 is guided displaceably between a lower housing part 11 and an upper housing part 12. Latching arm 5 is constituted integrally with lower housing part 11, and forms the left chamber wall of contact chamber 2. The right chamber wall of contact chamber 2 is constituted by a stationary partition 13 of lower housing part 11. Latching arm 5 extends opposite to insertion direction 6 and has at its elastically deflectable free end a latching hook 14 that protrudes laterally into contact chamber 2. A partition 15 is provided in upper housing part 12 between each two adjacent contact chambers 2. In its locked position, locking element 7 protrudes with a first locking projection 16 laterally into the respective right contact chamber 2, and in a transversely displaced clear position clears contact chamber 2 for insertion of a contact body 4. Locking elements 7 are shown in the clear positions in each of rows a-d of FIG. 1, and in the locked position in row e. Locking element 7 constitutes, with its left side facing away from first locking projection 16, a guide surface 17 in the respective left chamber 2 for a contact body 4, and likewise with its right side, facing toward locking projection 15, a guide surface 18 in the respective right contact chamber 2 for a contact body 4. The two guide surfaces 17, 18 of locking element 7 align respectively with partitions 13, 15 and with latching arm 5.

By way of a guide spring 19 provided on the lower side, locking element 7 is guided in transversely displaceable fashion in a guide groove 20 of lower housing part 11. Guide spring 19 has a second locking projection 21 (spacer element) that extends farther than first locking projection 7 in insertion direction 6 of contact body 4. In its locked position shown in FIG. 1 (row e), locking element 7 is shifted with second locking projection 21 behind latching arm 5, which is thereby blocked from deflecting out of its position protruding into contact chamber 2. In the clear position (rows a-d), second locking projection 21 is not located behind latching arm 5, which is therefore deflectable out of its position protruding into contact chamber 3.

The placement of contact bodies 4 into contact housing 1 is described below with reference to rows a through e, which respectively depict the progress over time of the placement operation:

In row a, locking element 7 is in its clear position and contact body 4 is inserted, through placement opening 3 of upper housing part 12 and between two partitions 15, into contact chamber 2. In rows b and c, contact body 4 is now also guided, by further insertion, between locking elements 7 and runs onto latching hooks 14, with the result that latching arm 5 is elastically deflected until, by further insertion, latching hook 14 ultimately engages or snaps into latching recess 10 of contact body 4 (row d). Locking element 7 is now displaced transversely (row e) into its locked position in which first locking projection 16 engages under a shoulder 22 of contact body 4 in insertion direction 6, and second locking projection 21 is located behind latching arm 5. Contact body 4 is thus locked in secondary fashion opposite to insertion direction 6, and latching arm 5 is secured in its position that latches contact body 4 in primary fashion.

Figure 2:
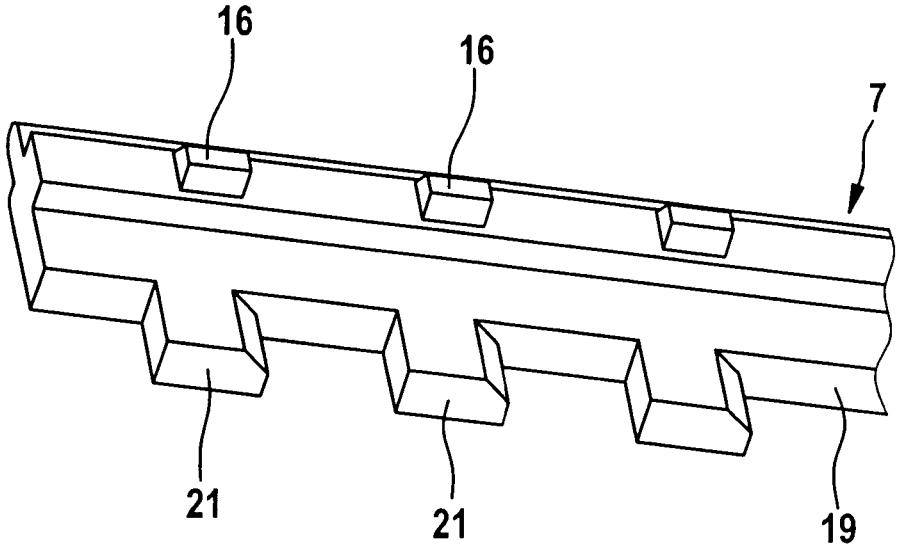
FIG. 2 is a perspective view of the locking element shown in FIG. 1.

Each of rows a-e has multiple contact chambers 2, a single pin-shaped locking element 7 being provided for each row. As FIG. 2 shows, locking element 7 has respective first and second locking projections 16, 21 for each of its contact chambers 2. At the end of the placement operation, locking element 7 is displaced transversely one-half contact-chamber width out of its clear position (shown in rows a-d) into the locked position shown in row e. Locking elements 7 thus on the one hand, with their first locking projections 16, test for the correct insertion depth of contact bodies 4, and on the other hand ensure additional (secondary) locking. Locking elements 7 furthermore, with their second locking projections 21, test for the correct primary latching position of latching arms 5 and additionally ensure locking thereof.

Figure 3:
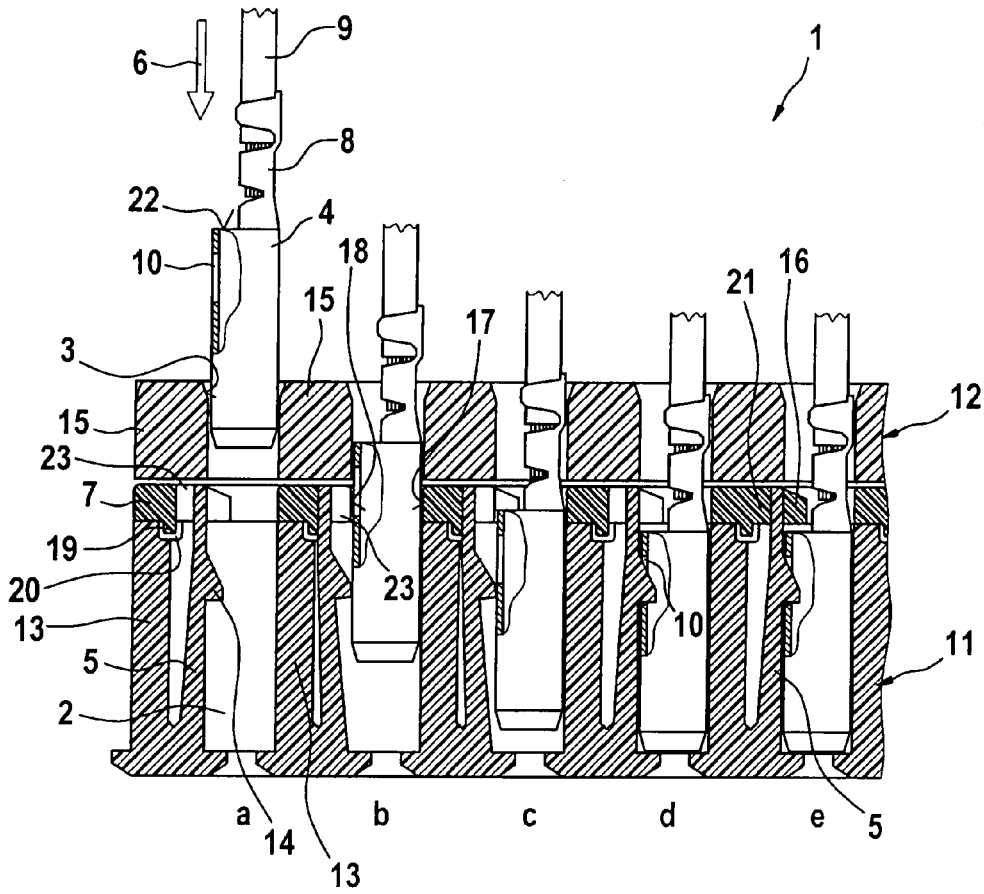
FIG. 3 shows, in a longitudinal section, a second exemplary embodiment of the contact housing according to the present invention, having multiple contact chambers and having contacts that are each inserted different distances into the contact chambers and latched in primary fashion and locked in secondary fashion therein.

Contact housing 1 shown in FIG. 3 differs from contact housing 1 of FIG. 1 only in that here, latching arm 5 engages with its upwardly elongated free end into a recess 23 of locking element 7. In the clear position of locking element 7 (rows a-d), recess 23 permits latching arm 5 to deflect out of contact chamber 2, whereas in the locked position (row e), latching arm 5 is blocked, by second locking projection 21 that laterally delimits recess 23, from deflecting out of its position protruding into contact chamber 2.

Figure 4:
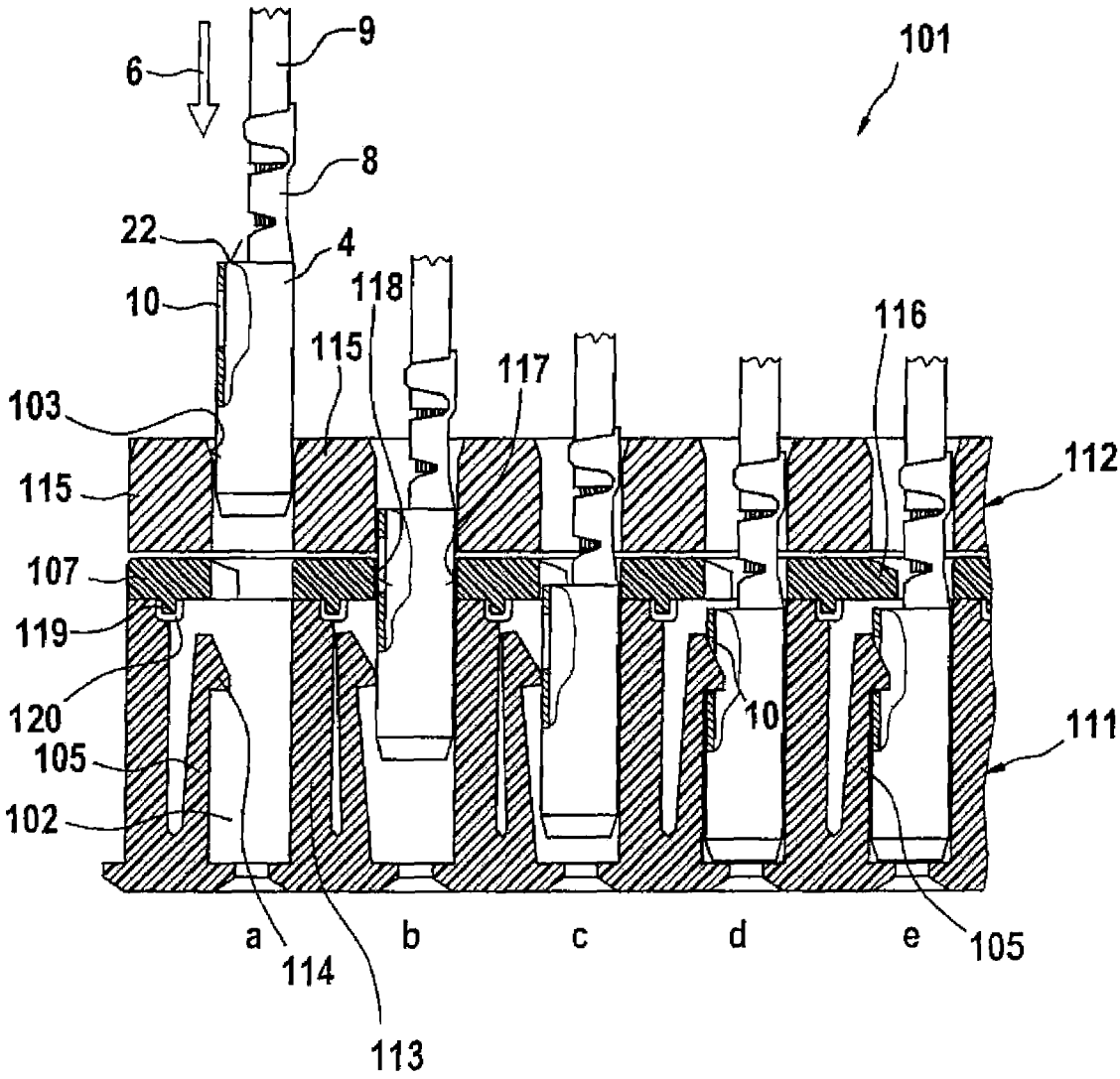
FIG. 4 shows, in a longitudinal section, a contact housing known in the existing art, having multiple contact chambers and having contacts that are each inserted different distances into the contact chambers and latched in primary fashion and locked in secondary fashion therein.

FIG. 4 shows a contact housing 101 known in the existing art. The placement of contact bodies 4 into contact housing 101 will be described below with reference to rows a to e, which respectively depict the progress over time of the placement operation:

In row a, locking element 107 is in its clear position and contact body 4 is inserted, through placement opening 103 and between two partitions 115 of upper housing part 112, into contact chamber 102. In rows b and c, contact body 4 is now also guided, by further insertion, between guide surfaces 1 17, 118 of two locking elements 107 and runs onto latching hooks 114, with the result that latching arm 105 is elastically deflected until, by further insertion, latching hook 114 ultimately engages or snaps into latching recess 10 of contact body 4 (row d). Locking element 107 is now displaced transversely into its locked position in which locking projection 116 engages under shoulder 22 of contact body 4 in insertion direction 6, and contact body 4 is thus locked opposite to insertion direction 6 (row e). Contact bodies 4 of rows d and e that are latched in primary fashion are laterally guided in contact chamber 102 over their entire length between latching arm 105 and a partition 113 of lower housing part 111, and thus exactly positioned. Locking elements 107 each have a central guide spring 119 that is guided in transversely displaceable fashion between lower housing part 111 and upper housing part 112 in a flat guide groove 120 of lower housing part 111.

What is claimed is:

1. A contact housing for an electrical plug connector, comprising:

a plurality of contact chambers, each of which for receiving a respective contact body insertable through a placement opening into the contact chamber;

a respective elastically deflectable latching arm, protruding laterally into the contact chamber, for primary latching of the contact body inserted to its end position into the contact chamber; and a respective locking element, displaceably guided transversely to an insertion direction of the contact body, that in its locked position protrudes, with a first locking projection, laterally into the contact chamber for secondary locking of the contact body latched in a primary fashion therein, the locking element having a second locking projection that, in the locked position of the locking element, blocks the latching arm against deflection out of its position protruding into the contact chamber.

2. The contact housing according to claim 1, wherein the latching arm extends opposite to the insertion direction.

3. The contact housing according to claim 1, wherein the second locking projection extends farther than the first locking projection in the insertion direction of the contact body.

4. The contact housing according to claim 1, further comprising a housing guide for guiding the locking element, with the second locking projection, in a transversely displaceable fashion.

5. The contact housing according to claim 1, wherein the plurality of contact chambers include a plurality of parallel rows of contact chambers, and for each row a respective transversely displaceable pin-shaped locking element is provided that has respectively, for each of its contact chambers, a first and a second locking projection.

6. The contact housing according to claim 1, wherein the plurality of contact chambers include a plurality of parallel rows of contact chambers, and for all the rows a transversely displaceable plate-shaped locking element is provided that has respectively, for each contact chamber, a first and a second locking projection.

7. The contact housing according to claim 1, wherein the latching arm penetrates through a locking plane of the first locking projection.

8. The contact housing according to claim 7, wherein the second locking projection is situated in the locking plane of the first locking projection.

* * * * *